US005176194A

United States Patent [19]

Chigusa

[11] Patent Number: 5,176,194

[45] Date of Patent: Jan. 5, 1993

[54] ROLLER SCREEN UNIT

[75] Inventor: Tomomichi Chigusa, Tokyo, Japan

[73] Assignee: Metaco Co., Ltd., Tokyo, Japan

[21] Appl. No.: 556,510

[22] Filed: Jul. 24, 1990

[51] Int. Cl.[5] ..... A47G 5/02

[52] U.S. Cl. ..... 160/273.1; 160/272

[58] Field of Search ..... 160/273.1, 271, 272

[56] References Cited

U.S. PATENT DOCUMENTS

| | | | |
|---|---|---|---|
| 236,126 | 12/1880 | Washburn | 160/273.1 X |
| 797,652 | 8/1905 | Wihon et al. | 160/273.1 X |
| 1,692,206 | 11/1928 | Griffiths | 160/273.1 X |
| 3,504,728 | 4/1970 | Wardlaw | 160/273.1 X |
| 4,175,608 | 11/1979 | Alton | 160/273.1 |
| 4,345,636 | 8/1982 | Fukuchi | 160/297 |

FOREIGN PATENT DOCUMENTS

| | | | |
|---|---|---|---|
| 49355 | 12/1931 | Norway | 160/273.1 |
| 189368 | 6/1937 | Switzerland | 160/273.1 |
| 489116 | 7/1938 | United Kingdom | 160/273.1 |

*Primary Examiner*—Carl D. Friedman
*Assistant Examiner*—Korie Hung Chan
*Attorney, Agent, or Firm*—Nikaido, Marmelstein, Murray & Oram

[57] ABSTRACT

Bead strings comprising beads connected by means of threadlike cords are provided on both edges of a screen member attached to a roller sleeve of the roller screen unit, and are engaged slidably with guide grooves of a pair of guide groove members arranged on both sides of the screen member. The beads have an aperture through the center thereof, with a string disposed in the apertures. A space portion of the string between each of the beads is attached to the screen member by sewing. This permits very smooth operation of drawing/expanding and winding/housing of the screen member, and facilitates more efficient design and manufacture of the unit.

2 Claims, 2 Drawing Sheets

FIG.1
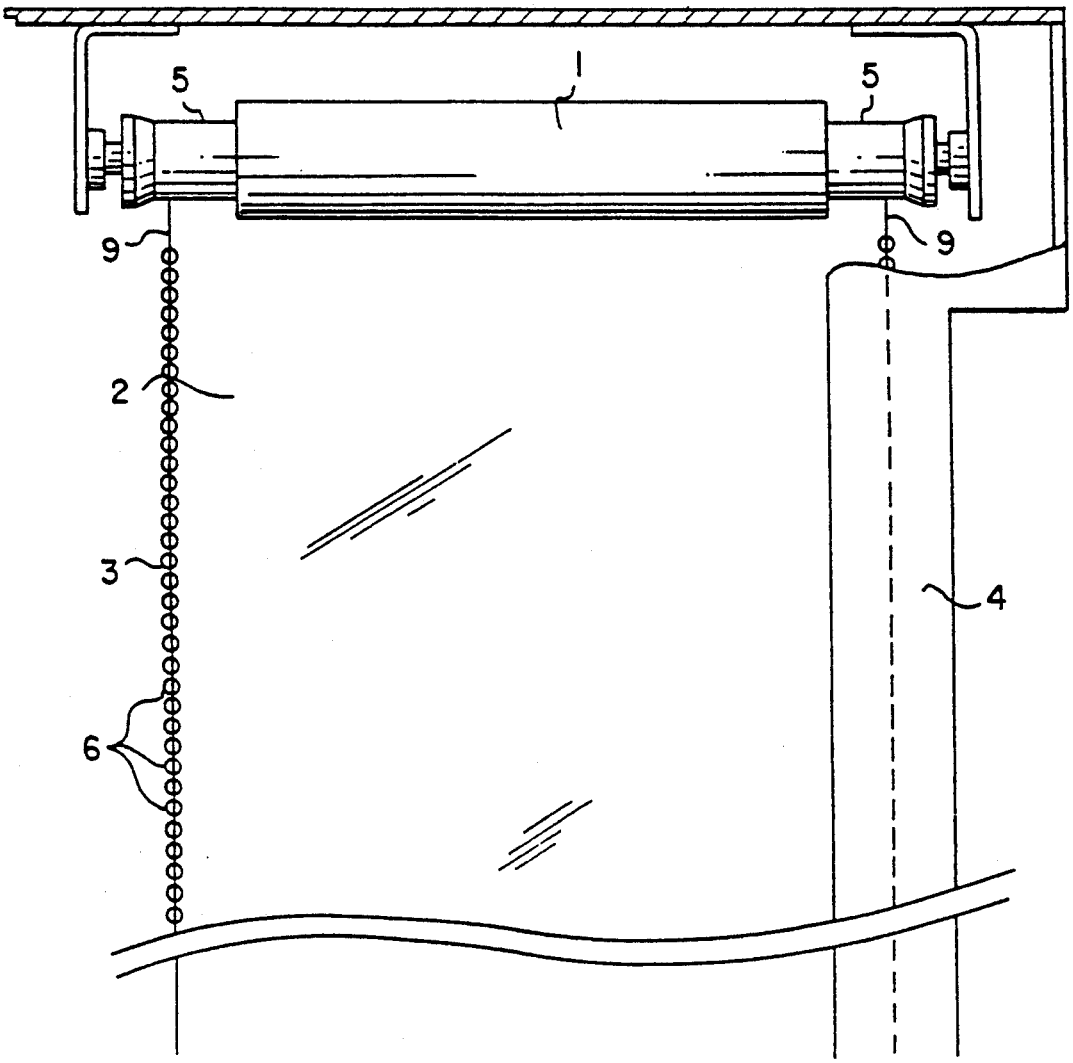
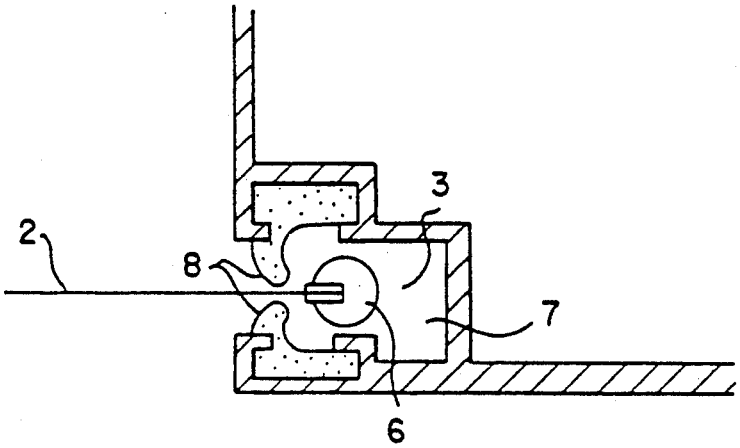
FIG.2

ROLLER SCREEN UNIT

FIELD OF THE INVENTION

The present invention relates to a roller screen unit, more particularly, to an improved roller screen unit which, in an automatic winding type roller screen unit using the torsion power of a spiral spring, permits effective shielding, soundproofing and insect control by covering the window frame opening with no gap, and allows smooth operations of drawing/expanding and winding/housing of the screen member without any unsteadiness.

DESCRIPTION OF PRIOR ART

An automatic winding type roller screen unit using the torsion power of a spiral spring built in a roller sleeve, of which imparting/accumulating and releasing/restoring permit drawing/expanding and winding/housing of a screen member such as a curtain, a blind, a light-weight shutter or a projection screen from the roller sleeve has conventionally been known.

In these conventional roller screen units, an end of the spiral spring is fixed to the interior of the roller sleeve attached with the screen member, and the other end thereof is connected to a pillow member rotatable with the roller sleeve, so that the spiral spring is caused to accumulate its torsion power when drawing/expanding the screen member, and the screen member is rolled up onto the roller sleeve by releasing the torsion power of the spiral spring. It is also possible in these roller screen units to stop the roller sleeve at a voluntary position.

Drawing/expanding and winding/housing of the screen member and stoppage thereof at an adequate position are achieved by a clutch mechanism provided on the roller screen unit.

Roller screen units using various winding mechanisms with different modifications to such a mechanism are also known.

In the conventional roller screen unit, however, there remains a gap between the window frame opening and the screen member, and the presence of this gap makes the shielding effect, soundproofing and insect control functions of the roller screen unit insufficient and further causes a problem of easy production of a unsteadiness of the screen member during drawing/expanding and winding/housing of the screen member.

To solve these problems, the inventors of the present invention have proposed a roller screen unit with guides, in which guide members are arranged on both edges of the screen member, and the guide members are slidably engaged with guide grooves in the guide groove members provided on both sides of the screen member. Fastenerlike members are used as these guide members.

However, problems still to be solved remain in the roller screen unit with guides so far proposed.

More specifically, engagement of the guide members eliminates flexibility of both edges of the screen member, thus impairing smooth operations of drawing/expanding and winding/housing of the screen member, and in addition, results in invevitable expansion of both edges of the screen member during winding and housing thereof. This roller screen unit with guides is, therefore, defective in that the scale and the shape of the unit are not compatible with the roller screen unit without a guide.

It is, therefore, an object of the present invention to provide a new improved roller screen unit which permits smooth operations of drawing-expanding and winding/housing of the screen member and allows easy manufacture.

Other objects and advantages of the present invention will be more fully described with reference to the accompanying drawings illustrative of preferred embodiments of the present invention.

BRIEF DESCRIPTION OF THE DRAWINGS

FIG. 1 is a partial front view illustrating the external appearance of the roller screen unit of the present invention;

FIG. 2 is a sectional view illustrating the engagement structure of the beads strings with the guide grooves provided in the guide groove members of the roller screen unit of the present invention.

DETAILED DESCRIPTION OF THE INVENTION

Figure 5:
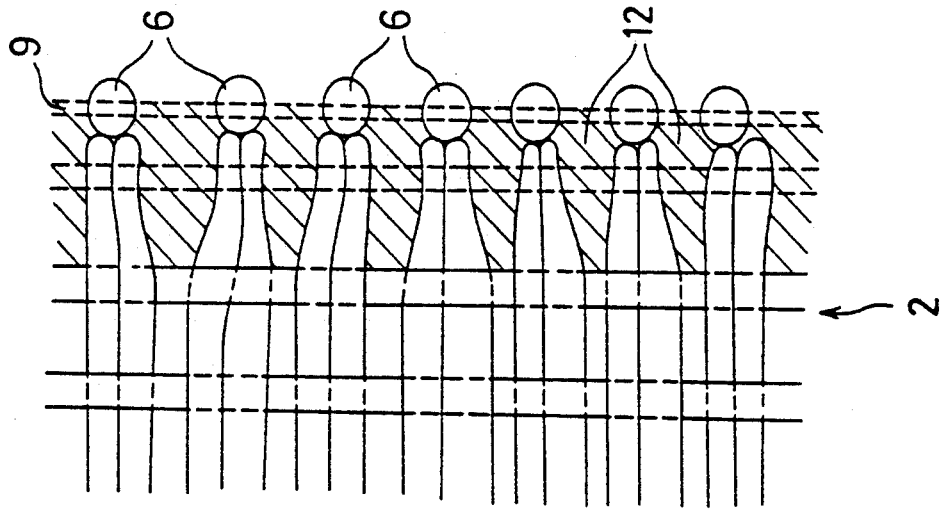
FIGS. 3, 4 and 5 are respectively partially cutaway side views illustrating connections of the beads strings to the screen member in the roller screen unit of the present invention.

Now, the roller screen unit of the present invention is described more detail by means of embodiments with reference to the drawings.

In the roller screen unit of the present invention, as shown in FIG. 1, drawing/expanding and winding/housing of a screen member (2), which may be any of various screen members, are achieved through imparting/accumulating and releasing/restoring of the torsion power of a spiral spring built in a roller sleeve (1).

The screen member (2) is attached to the roller sleeve (1), and beads strings (3) are arranged on both edges of the screen member (2). A pair of guide groove members (4) having opposing guide grooves of the guide groove members (4).

Escape portions (5) for rolling up the beads string (3) provided on the screen member (2) are provided on both sides of the roller sleeve (1). As the screen member (2), a screen member comprising any of such materials as cloth, a vinyl sheet and a metal net may be adopted. Any appropriate winding mechanism may be used for actuating the roller sleeve (1).

As shown in FIG. 2, beads (6) of the beads strings (3) attached to both edges of the screen member (2) do not come off the guide grooves (7) under the effect of packing (8) provided in the guide grooves (7). There is no particular limitation on the structure of the beads strings (3) and attachment thereof to both edges of the screen member (2). As the beads string (3), one consisting of beads (6) comprising a metal, a ceramic material or a resin having a diameter of from 2 to 3 mm connected by a threadlike cord may be employed.

Since sliding of the beads strings (3) is accomplished by means of balls in the form of beads (6), sliding contact with the packing (8) is smooth, thus permitting very smooth operations of drawing/expanding and winding/housing of the screen member (2). Sliding thereof is far smoother as compared with that in the conventional fastenerlike member type one.

Figure 4:
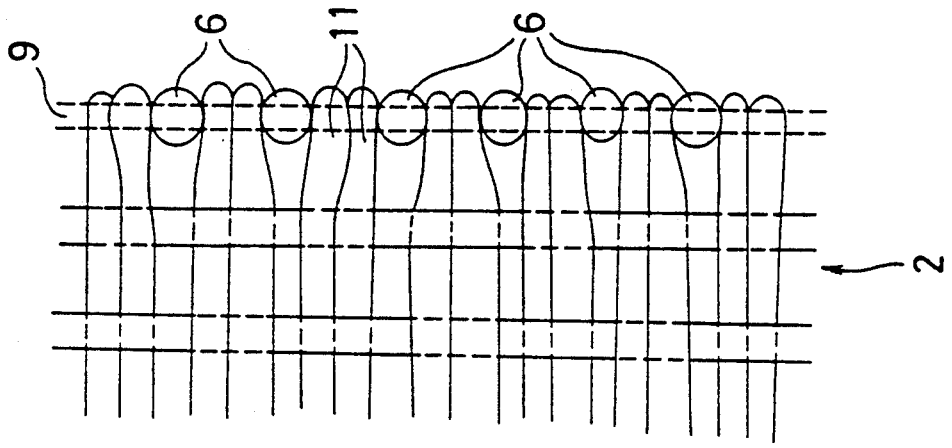
Figure 3:
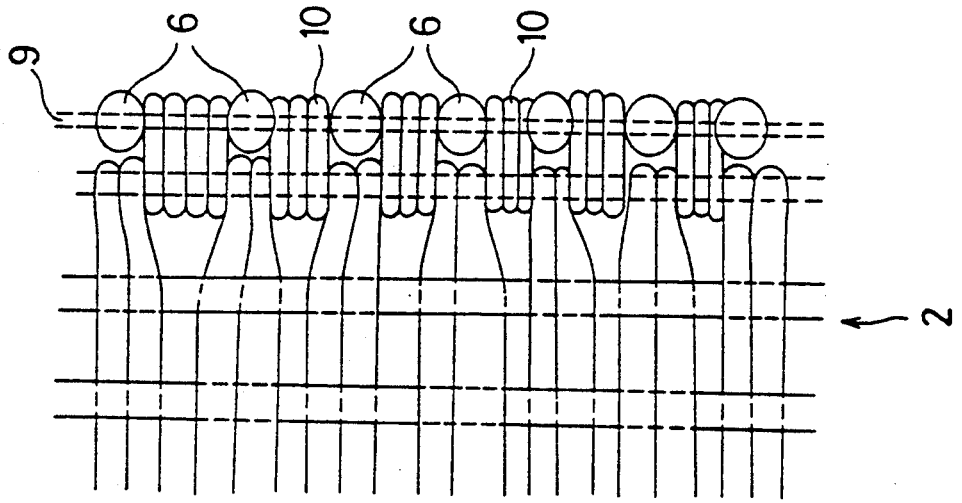

The beads of the beads strings (3) may be connected by means of a threadlike cord (9) as shown in FIG. 3, and intervals between beads may be sewed up by a string (10) on both sides of the screen member (2) or the portions thus sewed may further be secured by means of an adhesive. As shown in FIG. 4, furthermore, the threadlike cord (9) may be woven by means of crosswise threads (11) resulting from weaving of the screen member (2). As shown in FIG. 5, the threadlike cord (9) may be integrated with both edges of the screen member (2) through fastening by means of a resin (12). The interval between the beads and fitting thereof to the screen member (2) may be appropriately achieved through adjustment of the combination of the beads (6) and the threadlike cord (9).

According to the present invention, as described above, there is provided a roller screen unit with guides, which permits very smooth sliding by means of the beads strings and satisfactory operations of drawing/expanding and winding/housing of the screen member, and ensures effective shielding, soundproofing and insect control through coverage of the window frame opening for attachment with no gap.

It is needless to mention that the present invention is not limited to the embodiments described above, but may be applied in any of various embodiments.

What is claimed is:

1. An automatic winding type roller screen unit, comprising:

a roller sleeve having an interior space;

a spiral spring mounted in said interior space of said roller sleeve;

a screen member having two edges and two ends, with one end fixed to said roller sleeve, wherein energy in said spiral spring is accumulated within the roller sleeve during the drawing/expanding of the screen member, and the screen member is wound onto the roller sleeve when said energy is released;

bead string means having a plurality of beads mounted on a string and directly connected to each edge of said screen member, each of said beads having an aperture through a center thereof, with said string being disposed in said apertures, said bead string means further including a space portion on said string between each of said plurality of beads, and said space portion is attached to said screen sewing member by sewing; and a roller screen frame unit, said screen frame unit having guide groove means formed on opposing side thereof, wherein said bead string means is positioned within said guide groove means.

2. An automatic winding type roller screen unit as claimed in claim 1, wherein said bead string means is further secured to said screen member by an adhesive.

* * * * *